United States Patent [19]

Stern et al.

[11] Patent Number: 4,754,237

[45] Date of Patent: Jun. 28, 1988

[54] SWITCHABLE MILLIMETER WAVE MICROSTRIP CIRCULATOR

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 99,372

[22] Filed: Sep. 21, 1987

Related U.S. Application Data

[63] Continuation-in-part of Ser. No. 68,394, Jul. 1, 1987.

[51] Int. Cl.[4] ..... H01P 1/387

[52] U.S. Cl. ..... 333/1.1; 333/24.1

[58] Field of Search ..... 333/1.1, 24.1

[56] References Cited

U.S. PATENT DOCUMENTS

| | | | |
|---|---|---|---|
| 3,341,789 | 9/1967 | Goodman et al. | 333/1.1 |
| 3,456,213 | 7/1969 | Hershenov | 333/1.1 |
| 4,415,871 | 11/1983 | Stern | 333/1.1 |

OTHER PUBLICATIONS

U.S. patent application, Ser. No. 70,755, filed 6 Jul. 87, "Switchable Dielectric Waveguide Circulator".

*Primary Examiner*—Paul Gensler

*Attorney, Agent, or Firm*—Sheldon Kanars; Robert A. Maikis

[57] ABSTRACT

A millimeter wave switchable microstrip Y-junction circulator is provided comprising a monlithic, wye-shaped ferrite element disposed on one surface of a section of microstrip dielectric substrate having three, Y-junction oriented sections of microstrip conductor on the same one substrate surface and an electrically conductive ground plane on the opposite substrate surface. The ferrite element has a central right prism-shaped portion with two equilateral triangular-shaped prism bases and three rectangular prism faces and three downwardly-sloping arm portions which extend radially outwardly from the prism faces of the central portion. The top base of the ferrite element central portion and the top surface of the ferrite arm portions which do not rest on the substrate are provided with microstrip conductors which cooperate with the ground plane to convey millimeter wave signals applied to the three Y-junction oriented microstrip sections on the substrate to the ferrite element central portion. Each ferrite arm portion has a lateral opening therethrough and a single turn of electric control current wire is threaded through all three openings to create a magnetic field in the ferrite central portion which causes it to act as a circulator to selectively couple the three microstrip sections on the substrate.

5 Claims, 3 Drawing Sheets

SWITCHABLE MILLIMETER WAVE MICROSTRIP CIRCULATOR

STATEMENT OF GOVERNMENT RIGHTS

The invention described herein may be manufactured, used and licensed by or for the Government for governmental purposes without the payment to us of any royalties thereon.

RELATED APPLICATIONS

This application is a continuation-in-part of U.S. patent application Ser. No. 068,394, filed July 1, 1987, by the applicants of the present application.

BACKGROUND OF THE INVENTION

1. Field of the Invention

This invention relates to microstrip transmission lines operating in the millimeter wave region of the frequency spectrum and more particularly to a switchable microstrip Y-junction circulator for use with such microstrip transmission lines.

2. Description of the Prior Art

A problem arising in millimeter wave frequency applications which utilize microstrip transmission line and other planar circuit components is the switching of the millimeter wave frequency signals involved. Because of the extremely small physical size of the microstrip and other components used in this region of the frequency spectrum, the switching function should be accomplished by a device of small physical size which preferably consumes very little energy to accomplish the switching function. Although active diode elements are often used to perform the switching function, they require a constant consumption of power which is undesirable for many applications. Furthermore, the design of the switching device should be as simple as possible to facilitate manufacturing of the device and to keep the manufacturing costs as low as possible. Since switches are often called upon to perform modulation functions, a suitable switching device for applications of this type should also be capable of functioning as a modulator.

Y-junction circulators are non-reciprocal coupling devices having three ports which provide signal transmission from one port to an adjacent port while decoupling the signal from the remaining port. They are used in radar system front ends as duplexers to couple the transmitter and receiver to the single radar antenna. They are also used in many other applications such as signal generator protection circuits and transmitter injection locking circuits, for example. A circulator could be used to perform a switching function if the circulator itself could be made switchable. For a circulator to be switchable, the rotational direction of circulator coupling action must be easily reversed so that a signal applied to one port of a Y-junction circulator may be switched to either of the two adjacent ports. With the great increase in use of planar circuitry using microstrip transmission lines in millimeter wave frequency applications because of the resulting reduction in size and weight of the equipment involved, a need has arisen for a Y-junction circulator which is suitable for use with such planar circuitry and microstrip transmission lines and which is easily switchable.

Conventional millimeter wave microstrip circulator designs generally utilize a small ferrite disc or "puck" which has metallized ends and which is disposed in a hole in the microstrip transmission line substrate at the point where the microstrip lines to be coupled meet. The puck has a thickness which is equal to the thickness of the microstrip transmission line substrate so that the metallized ends of the puck may be electrically connected to the microstrip conductors and the metal ground plane of the transmission line. When a unidirectional magnetic field is applied between the ends of the puck, a clockwise or counterclockwise non-reciprocal coupling action is produced between the microstrip lines which are joined at the puck. The clockwise or counterclockwise coupling direction may be reversed by reversing the direction of the applied magnetic field. A circulator of this type is shown and described in U.S. Pat. No. 3,456,213 issued July 15, 1969. This circulator is not easily switchable, however, with the permanent magnet arrangement disclosed by the patentee. If the magnetic field is created by a helically-wound coil, the coil would require a pole structure which would increase the size and weight of the circulator to the point where its use would no longer be feasible in millimeter wave applications.

The manufacturing and assembly costs of the puck-type circulators are relatively high because the ferrite puck must be fitted into the substrate hole with a very close tolerance fit to minimize line impedance variations and to reduce insertion losses. Additionally, if the dielectric constant of the microstrip substrate is different from the dielectric constant of the ferrite, a matching transformer configuration is required which further increases the aforementioned costs. Furthermore, the ferrite puck arrangement is not readily adapted to the monolithic design and automated assembly techniques which must be utilized in the fabrication of microstrip circuits in order to reduce their complexity and cost.

SUMMARY OF THE INVENTION

It is an object of this invention to provide a switchable microstrip Y-junction millimeter wave circulator of relatively simple design which readily lends itself to monolithic fabrication and automated assembly techniques.

It is a further object of this invention to provide a switchable microstrip Y-junction millimeter wave circulator of small size and low weight which is relatively inexpensive to manufacture and to assemble.

It is a still further object of this invention to provide a switchable microstrip Y-junction millimeter wave circulator which may be installed in microstrip transmission line applications with a simple "drop-in" assembly technique and which avoids the close tolerance fitting techniques required for conventional circulators.

It is another object of this invention to provide a switchable microstrip Y-junction circulator which utilizes only a small amount of energy to perform the switching function and which can be employed as a modulator in millimeter wave applications.

It is an additional object of this invention to provide a switchable microstrip Y-junction millimeter wave circulator which eliminates the need for impedance matching transformers.

Briefly, the switchable microstrip Y-junction circulator of the invention comprises a microstrip dielectric substrate which has planar top and bottom surfaces and an electrically conductive ground plane mounted on the bottom surface of the substrate. A wye-shaped ferrite element is mounted on the top surface of the substrate and has a central portion shaped as a right prism having three rectangular prism faces of equal area and top and bottom prism bases shaped as eqilateral triangles. The bottom prism base abuts the top surface of the substrate. The ferrite element also has three arm portions which extend radially outwardly from the prism faces. Each of the arm portions have a width equal to the width of the prism face from which it extends and a height which decreases linearly from the full height of the top prism base above the bottom prism base at the end of the arm which abuts the prism face to zero height at the other end of the arm, so that the top surface of each of the arm portions slopes downwardly from the top base of the prism-shaped central portion and the bottom surface of each arm portion is coplanar with the bottom base of the prism-shaped central portion and abuts the top surface of the substrate. The arm portions have a plurality of bores therein substantially disposed in a plane intermediate and parallel to the prism bases. Each of the bores extends the full width of the arm portion associated therewith and disposed adjacent a different prism face of the three prism faces with the longitudinal axis of the bore substantially parallel to the prism face associated therewith. Electrically conductive microstrip conductor means are associated with each of the ferrite element arm portions and have a first portion thereof mounted on the top base of the prism-shaped central portion of the ferrite element, a second portion thereof extending down the sloping top surface of the ferrite element arm portion associated therewith and a third portion thereof mounted on the top surface of the substrate in alignment with the ferrite element arm portion associated therewith. Means are provided for carrying an electric control current through each of the bores to create a circular magnetic field about the longitudinal axis of each of the bores and a resultant magnetic field comprising the sum of the circular magnetic fields between the prism bases, so that each prism face is adapted to act as a circulator port and the rotational direction of circulator coupling action about the central axis of the prism can be controlled by controlling the control current.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
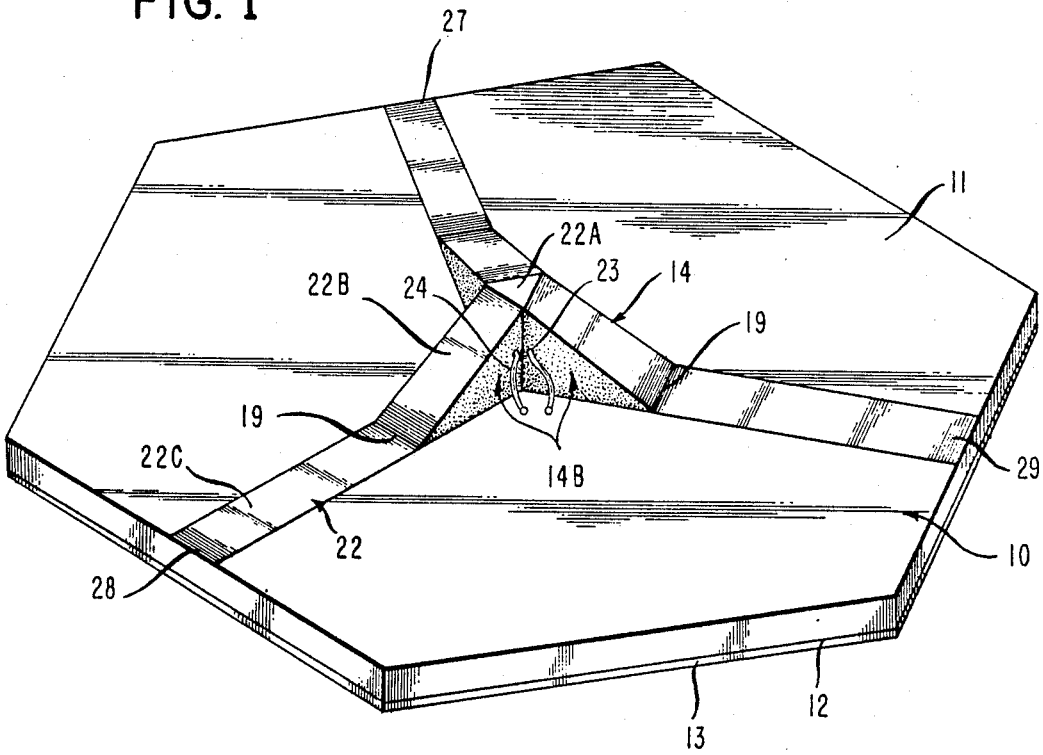
FIG. 1 is a perspective view of the switchable microstrip Y-junction circulator of the invention.
Figure 2:
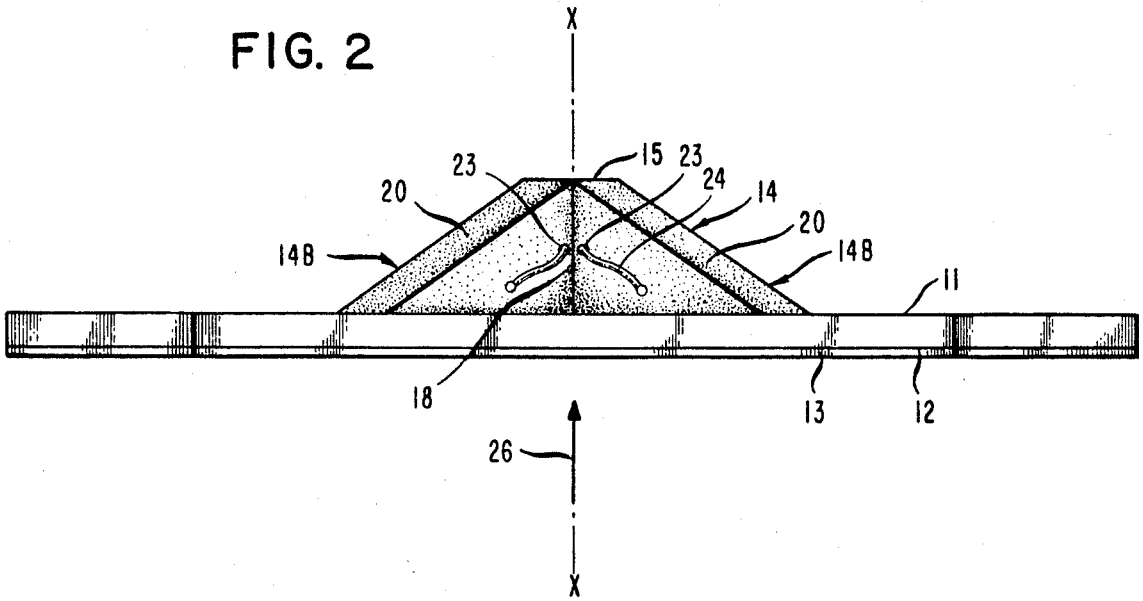
FIG. 2 is a front elevational view of the switchable circulator of FIG. 1 with the microstrip conductor means omitted for clarity of illustration.

Referring now to FIGS. 1 and 2 of the drawings, there is shown a switchable microstrip Y-junction circulator constructed in accordance with the present invention comprising a microstrip dielectric substrate, indicated generally as 10, which has a planar top surface 11 and a planar bottom surface 12. The substrate 10 may comprise a section of conventional microstrip transmission line substrate which is usually fabricated of duroid or other similar dielectric material having a relatively low dielectric constant. An electrically conductive ground plane 13 which is fabricated of a good conducting metal, such as copper or silver, for example, is mounted on the bottom surface 12 of the substrate and covers that entire surface.

Figure 5:
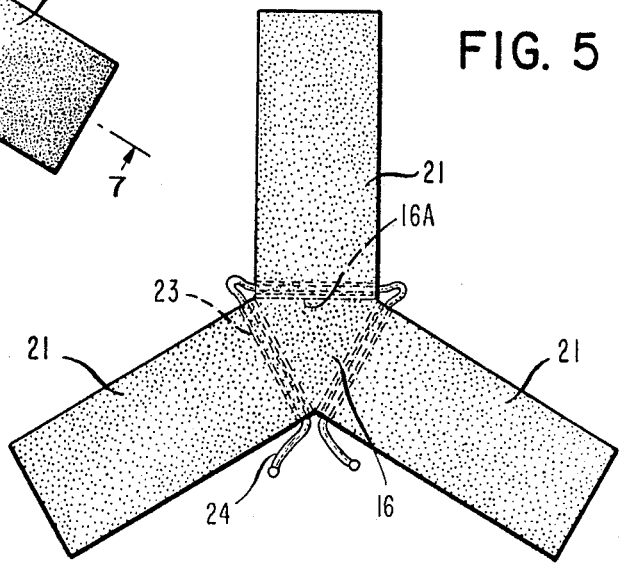
FIG. 5 is a bottom plan view of the wye-shaped ferrite element shown in FIG. 3 with the bottom prism base shown schematically by dot-dash lines.
Figure 3:
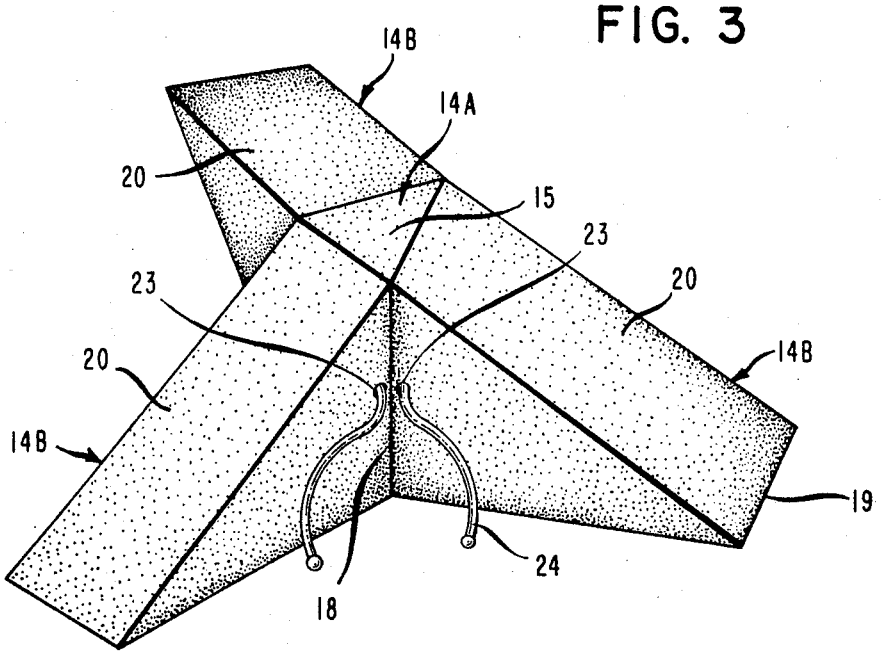
FIG. 3 is a perspective view of the wye-shaped ferrite element which is mounted on the substrate of the circulator of FIGS. 1 and 2.
Figure 6:
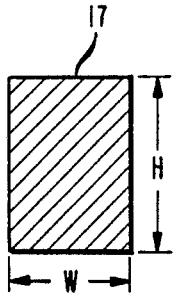
FIG. 6 is a full sectional view taken along the line 6—6 of FIG. 4 showing a prism face.

A wye-shaped ferrite element, indicated generally as 14, is mounted on the top surface 11 of the substrate 10. The element 14 may be fabricated of a ferrite material, such as nickel zinc or lithium ferrite, for example, which exhibits gyromagnetic behavior in the presence of a unidirectional magnetic field. As may be seen in FIGS. 3–6 of the drawings, although the ferrite element 14 is shown as a monolithic structure, it may be thought of as having a central portion, indicated generally as 14A, which is shaped as a right prism and three arm portions, indicated generally as 14B, which extend radially outwardly from the central portion. The prism-shaped central portion 14A has a top prism base 15 and a bottom prism base 16 (defined by the dot-dash lines 16A in FIG. 5) each of which is shaped as an equilateral triangle. The bottom prism base 16 abuts the top surface 11 of the substrate 10. The prism-shaped central portion 14A has three rectangular prism "faces" 17 of equal area as shown in FIG. 6 of the drawings.

The three arm portions 14B extend radially outwardly from the three prism faces 17. Each of the arm portions 14B has a width which is equal to the width W of the prism face 17 from which it extends and a height which decreases linearly from the full height H of the top prism base above the bottom prism base at the end 18 of the arm which abuts the prism face 17 to zero height at the other end 19 of the arm, so that the top surface 20 of each of the arm portions slopes downwardly from the top base 15 of the central portion 14A and the bottom surface 21 of each arm portion is coplanar with the bottom base 16 of the central portion 14A. The bottom surface 21 of each arm portion abuts the top surface 11 of the substrate 10 together with the bottom prism base 16 so that all of the bottom surfaces of the ferrite element 14 are coplanar.

Referring again to FIG. 1 of the drawings, it will be seen that each of the arm portions 14B of the ferrite element 14 has electrically conductive microstrip conductor means, indicated generally as 22, associated therewith. Each microstrip conductor means has a first portion 22A thereof which is mounted on the top base 15 of the prism-shaped central portion 14A of the ferrite element, a second portion 22B thereof which extends down the sloping top surface 20 of the ferrite element arm portion associated therewith and a third portion 22C thereof which is mounted on the top surface 11 of the microstrip substrate 10 in alignment with the ferrite element arm portion associated therewith. Since the top and bottom prism bases 15 and 16, respectively, are shaped as equilateral triangles, it follows that each of the arm portions 14B of the ferrite element 14 and the portion 22C of the microstrip conductor means associated with that arm portion are spaced 120 degrees apart in a Y-junction oriented configuration on the top surface 11 of the substrate 10. The microstrip conductor means 22 should again be fabricated of a good electrically conductive metal, such as copper or silver, for example.

Figure 4:
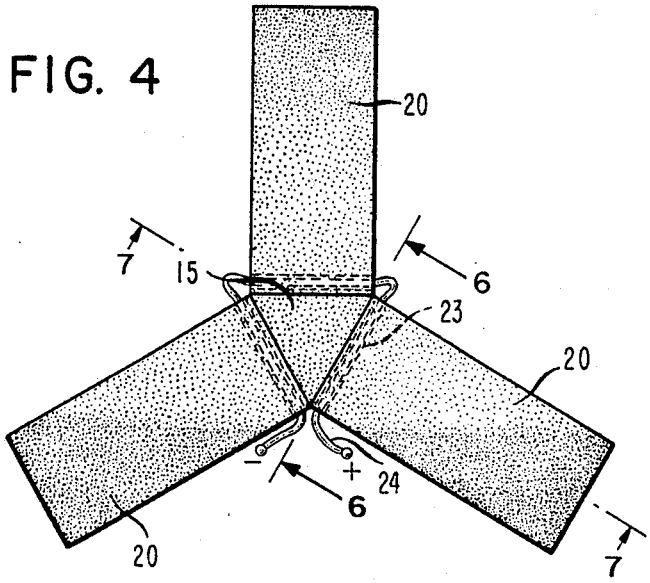
FIG. 4 is a top plan view of the wye-shaped ferrite element shown in FIG. 3.

Each of the arm portions 14B has a bore 23 therein which extends the full width of the arm portion so that an opening is formed in the arm portion which extends all the way through the arm portion. The three bores 23 are substantially disposed in a single plane which is substantially parallel to and intermediate the prism bases 15, 16 so that the longitudinal axis of each of the bores is also substantially parallel to the planes of the prism bases. The plane in which the bores lie should be located at or slightly below the midpoint of the distance between the prism base 15 and the prism base 16 for reasons which will be discussed hereinafter. As illustrated in FIGS. 4 and 5, each of the bores 23 is disposed adjacent a different one of the three prism faces 17 with the longitudinal axis of each bore substantially parallel to the prism face 17 associated therewith. Finally, electric control current carrying means, such as the single turn of electrically conductive wire 24 illustrated, for example, is threaded through each of the bores 23 in the same rotational direction about the central axis X—X of the prism-shaped central portion 14A of the ferrite element 14. The prism central axis X—X is shown in FIG. 2 and is perpendicular to the planes of the prism bases 15, 16 and spaced equidistant from the three prism faces 17.

Figure 7:
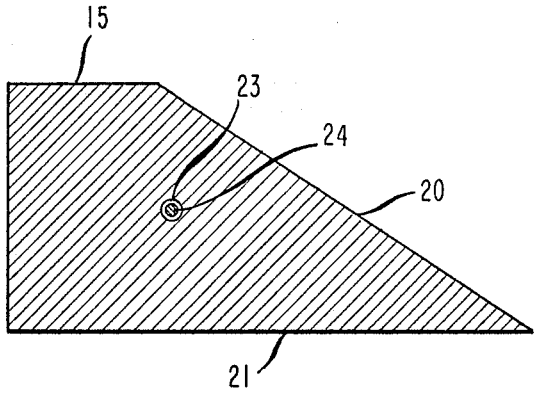
FIG. 7 is a full sectional view taken along the line 7—7 of FIG. 4 showing a single bore and the control current carrying wire therein.
Figure 8:
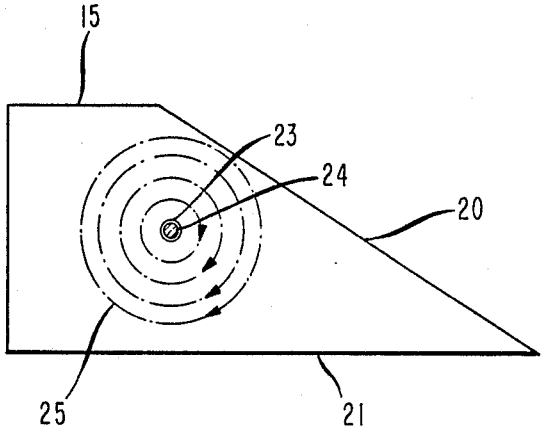
FIG. 8 is a schematic view showing the circular magnetic field created about the longitudinal axis of the bore which is shown in the view of FIG. 7.

When a dc current is passed through the wire 24, a circular magnetic field will be created about the longitudinal axis of each of the bores 23 because the material of the ferrite arm portion 14B in which the bore is located and the material of the ferrite central portion 14A form a closed toroidal flux path about the longitudinal axis of the bore. For example, FIG. 8 of the drawings shows the circular magnetic field, indicated schematically as 25, which is created about the longitudinal axis of the bore in the ferrite arm portion 14B shown in FIG. 7 when a dc voltage having the polarity shown in FIG. 4 is applied to the terminals of the wire 24. Since the wire 24 passes through each of the bores 23 in the same rotational direction about the prism central axis X—X, i.e., starting from one of the terminals of wire 24 it continues always in the same rotational direction about the prism central axis until it reaches the other terminal of the wire, the circular magnetic fields existing about each of the bores 23 will be added together or summed in the prism-shaped central portion 14A of the ferrite element 14 to create a resultant magnetic field between the two prism bases 16 and 16. This resultant magnetic field would be a dc magnetic field which could be represented schematically by an arrow 26 aligned with the prism central axis X—X as shown in FIG. 2. The direction or polarity of the resultant magnetic field would, of course, depend upon the polarity of the dc voltage applied to the terminals of wire 24. For the dc voltage polarity shown in FIG. 4, the direction of the resultant magnetic field 26 would be that shown in FIG. 2.

By virtue of the foregoing arrangement, the central portion 14A of the ferrite element 14 in conjunction with the applied unidirectional resultant magnetic field 26 acts as a ferrite circulator with respect to electromagnetic wave energy applied to the three prism faces 17 of the central portion 14A. The operation of a ferrite circulator of this type is described in U.S. Pat. No. 4,415,871 which was issued to the inventors of the present invention on Nov. 15, 1983 and is assigned to the assignee of the present application. The three portions 22C of the microstrip conductor means 22 act as the three ports, designated 27, 28 and 29, of the microstrip circulator as shown in FIG. 1 of the drawings. Each of these short lengths of microstrip conductor 22C in combination with the microstrip substrate 10 and the ground plane 13 form a separate microstrip transmission line as is well known in the art and may be easily coupled to the microstrip transmission lines or other planar circuits which are to be selectively coupled by the microstrip circulator of the the invention. The three arm portions 14B of the ferrite element 14 act as transitions to bridge the height difference between the microstrip dielectric substrate 10, which is usually 0.010 inch thick, and the prism-shaped central portion 14A of the ferrite element which may have a height H on the order of 0.070 inch, for example The portions 22A and 22B of the microstrip conductor means 22 act in conjunction with the microstrip substrate 10 and the ground plane 13 to convey millimeter wave signals which may be applied to the circulator ports 27, 28 and 29 to the prism-shaped central portion 14A of the ferrite element. Since the dielectric constant of the ferrite material is usually much higher than the dielectric constant of the microstrip substrate material, when the applied signals reach the portion 22A of the microstrip conductor means they are captured by the ferrite material of the central portion 14A.

With the foregoing arrangement, if a millimeter wave signal to be switched is applied, for example, to port 27 of the circulator and if the direction of the resultant magnetic field 26 created by the control current in control wire 24 is such to give the circulator a clockwise circulator coupling action about the prism central axis X—X, the applied signal will be coupled to circulator port 29 and decoupled from circulator port 28. If the direction of the control current in control wire 24 is reversed, the direction of the resultant magnetic field will be reversed to thereby create a counterclockwise circulator coupling action which will cause the applied signal to be coupled to circulator port 28 and decoupled from circulator port 29. Accordingly, the circulator of the invention may be switched from one rotational direction of circulator coupling action to the other rotational direction of circulator coupling action merely by reversing the polarity of the control voltage applied to the terminals of control wire 24, so that the circulator may be employed as a switch or a modulator in planar circuit applications.

In order to minimize the electrical energy required to accomplish the switching function, the resultant magnetic field roduced by the electric control current in wire 24 should be as large as possible for the smallest amount of control current. This may be accomplished by making the reluctance of the toroidal flux path around the longitudinal axis of each of the bores 23 as small as possible since this will maximize the three circular magnetic fields which together form the resultant magnetic field. Accordingly, ngly, as may be seen from an inspection of FIGS. 7 and 8, the plane in which the three bores 23 lie should be at the midpoint nt of the height H of the central portion 14A of the ferrite element or somewhat below that, i.e., closer to the prism base 16 then to the prism base 15, to substantially equalize the distance between the wall of each bore to the downwardly sloping top surface 20 of the arm portion 14B and the distance between the wall of the bore to the bottom surface 21 of the arm portion. Additionally, it is apparent that the bore in each arm portion should be located as close as possible to the prism "face" 17 with which it is associated.

When the ferrite element 14 is fabricated of a ferrite material having a "square" hysteresis loop, such as nickel zinc ferrite or lithium zinc ferrite, for example, the prism-shaped central portion 14A may be latched into either of two magnetic states having opposite directions of the resultant magnetic field 26 by the application of only a small pulse of dc control current. By applying a control current pulse of one polarity the prism-shaped central portion 14A will be latched into one magnetic state in which it will remain until a second control current pulse of opposite polarity is applied to latch the ferrite into its other magnetic state. This would eliminate the use of electric control current holding circuits to keep the circulator in a particular rotational direction of circulator coupling action and would further minimize the amount of control current energy required to accomplish the switching function.

For the construction of prototype or other "limited quantity" circulators, the wye-shaped ferrite element 14 may be fabricated by ultrasonically cutting it out of a 0.070 inch slab of nickel zinc ferrite, for example. The downwardly sloping arm portions 14B of the ferrite element 14 may be obtained by grinding the arm portions after the wye-shaped element is cut from the slab of ferrite. The bores 23 may be formed in the arm portions by any suitable means, such as drilling, for example. The portions 22A and 22B of the microstrip conductor means which are disposed on the top surfaces of the ferrite element may be formed by a sputtering technique so that these portions in effect constitute a single length of microstrip conductor for each arm portion 14B. The wye-shaped ferrite element 14 may then be dropped into place on a prepared microstrip substrate fabricated of duroid and containing the three, 120 degree-spaced apart portions 22C of the microstrip conductor means and a suitable ground plane. The ends of the portions 22C of the microstrip conductor means on the substrate surface are then soldered to the corresponding ends of the microstrip conductor means portions on the top surfaces of the wye-shaped ferrite element 14. The assembly is completed by the insertion of the wire 24 in the bores 23. If desired, the ferrite element may be bonded.by an epoxy cement or other suitable bonding material to the substrate surface to insure good mechanical rigidity.

It may be seen from the foregoing description of the assembly technique which may be employed for the aforementioned prototype or "limited quantity" circulators that the overall design of the microstrip circulator of the invention readily lends itself to automated assembly techniques and that the close tolerance fitting operation required for existing microstrip circulators has been eliminated in favor of a simple "drop-in" assembly step. The ferrite element 14 itself is monolithic in construction because the central portion 14A and the three arm portions 14B are integral parts of the element. Accordingly, the ferrite element could be produced in production quantities by molding ferrite powder into the required size and shape and then firing it into final form. Although the ferrite element central portion 14A and the arm portions 14B could be fabricated separately and then bonded together, the insertion of the necessary bond would probably increase the impedance and overall insertion loss somewhat of the microstrip circulator to no advantage. Despite the fact that the ferrite circulator element has a substantially greater thickness than the thickness of the microstrip substrate and that it has been placed on top of the substrate which should cause a substantial increase in the impedance of the three microstrip transmission lines which are coupled by the ferrite element, it has been found that the actual impedance change is minimal so that there is no need for impedance matching transformers or other similar devices. Although the overall increase in thickness of the dielectric material between the microstrip conductors and the ground plane causes the impedance of the three microstrip sections to increase, the overall dielectric constant of the this material is also increasing because the dielectric constant of the ferrite material is so much greater than the dielectric constant of the microstrip substrate material. For example, the nickel zinc ferrite mentioned has a dielectric constant of 13 while the duroid substrate has a dielectric constant of 2.2. Thus, there is a trade off between impedance gain and loss which substantially balances each other out for a minimal resultant impedance change.

It is believed apparent that many changes could be made in the construction and described uses of the foregoing switchable microstrip Y-junction circulator and many seemingly different embodiments of the invention could be constructed without departing from the scope thereof. For example, although the circulator of the invention has been described with reference to use in the millimeter wave region of the frequency spectrum, it is apparent that the circulator is not limited in use to applications in this frequency region. Accordingly, it is intended that all matter contained in the above description or shown in the accompanying drawings, shall be interpreted as illustrative and not in a limiting sense.

What is claimed is:

1. A switchable microstrip Y-junction circulator comprising a microstrip dielectric substrate having planar top and bottom surfaces;

an electrically conductive ground plane mounted on the bottom surface of said substrate;

a wye-shaped ferrite element mounted on the top surface of said substrate, said ferrite element having a central portion shaped as a right prism having three rectangular prism faces of equal area and top and bottom prism bases shaped as equilateral triangles, said bottom prism base abutting the top surface of said substrate, three arm portions extending radially outwardly from said prism faces, each of said arm portions having a width equal to the width of the prism face from which it extends and a height which decreases linearly from the full height of the top prism base above the bottom prism base at the end of the arm which abuts the prism face to zero height at the other end of the arm, so that the top surface of each of said arm portions slopes downwardly from the top base of said prism-shaped central portion and the bottom surface of each arm portion is coplanar with the bottom base of said prism-shaped central portion and abuts the top surface of said substrate, and a plurality of bores in said arm portions substantially disposed in a plane intermediate and parallel to said prism bases, each of said bores extending the full width of the arm portion associated therewith and being disposed adjacent a different prism face of said three prism faces with the longitudinal axis of the bore substantially parallel to the prism face associated therewith;

electrically conductive microstrip conductor means associated with each of said ferrite element arm portions, said microstrip conductor means having a first portion thereof mounted on the top base of the prism-shaped central portion of said ferrite element, a second portion thereof extending down the sloping top surface of the ferrite element arm portion associated therewith and a third portion thereof mounted on the top surface of said substrate in alignment with the ferrite element arm portion associated therewith; and means for carrying an electric control current through each of said bores to create a circular magnetic field about the longitudinal axis of each of said bores and a resultant magnetic field comprising the sum of said circular magnetic fields between said prism bases, so that each of said prism faces is adapted to act as a circulator port and the rotational direction of circulator coupling action about the central axis of the prism can be controlled by controlling said control current.

2. A switchable microstrip Y-junction circulator as claimed in claim 1 wherein the number of said bores equals the number of said prism faces.

3. A switchable microstrip Y-junction circulator as claimed in claim 2 wherein said electric control current carrying means comprises electrically conductive wire means threaded through each of said bores.

4. A switchable microstrip Y-junction circulator as claimed in claim 3 wherein said electrically conductive wire means comprises a single turn of wire passing through each of said bores in the same rotational direction about the central axis of said prism.

5. A switchable microstrip Y-junction circulator as claimed in claim 4 wherein said wye-shaped ferrite element is fabricated of a ferrite material having a square hysteresis loop so that the polarity of said resultant magnetic field may be latched from one state to the opposite state by the application of a control current pulse to said single turn of wire.

* * * * *